US007566371B2

(12) United States Patent
Arita et al.

(10) Patent No.: US 7,566,371 B2
(45) Date of Patent: Jul. 28, 2009

(54) NON-ORIENTED ELECTRICAL STEEL SHEET EXCELLENT IN MAGNETIC PROPERTIES IN ROLLING DIRECTION AND METHOD OF PRODUCTION OF SAME

(75) Inventors: Yoshihiro Arita, Kitakyushu (JP); Kenichi Murakami, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 404 days.

(21) Appl. No.: 11/357,782

(22) Filed: Feb. 17, 2006

(65) Prior Publication Data

US 2006/0185767 A1 Aug. 24, 2006

(30) Foreign Application Priority Data

Feb. 23, 2005 (JP) ..... 2005-047289
Dec. 26, 2005 (JP) ..... 2005-372978

(51) Int. Cl.
*H01F 1/147* (2006.01)

(52) U.S. Cl. ..... 148/111; 148/112

(58) Field of Classification Search ..... None
See application file for complete search history.

(56) References Cited

U.S. PATENT DOCUMENTS

2005/0000596 A1* 1/2005 Schoen et al. ..... 148/111
2005/0206267 A1* 9/2005 Koshiishi et al. ..... 310/216
2007/0023103 A1* 2/2007 Schoen et al. ..... 148/111

FOREIGN PATENT DOCUMENTS

CN 1278016 A 12/2000
EP 0 779 369 A1 * 6/1997
JP 2001-59145 3/2001
JP 2002-146490 5/2002
JP 2004-332042 * 11/2004

OTHER PUBLICATIONS

Machine Translation of Japanese Patent Document No. 2004-332042.*

English Language Abstract of Japanese Patent Document No. 57-203718 (Publication Date of Japanese Document—Dec. 14, 1982).*

* cited by examiner

*Primary Examiner*—John P. Sheehan
(74) *Attorney, Agent, or Firm*—Kenyon & Kenyon LLP

(57) ABSTRACT

Non-oriented electrical steel sheet remarkably improved in magnetic properties in the rolling direction by a method superior in cost and productivity, that is, non-oriented electrical steel sheet excellent in magnetic properties in the rolling direction comprising, by wt %, Si in an amount of 2.0% or less, Mn in 3.0% or less, Al in 1.0% to 3.0%, at least one of Sn, Sb, Cu, Ni, Cr, P, REM, Ca, and Mg in a total of 0.002% to 0.5%, and a balance of Fe and unavoidable impurities and having a ratio ($B50_L$/Bs) of the magnetic flux density $B50_L$ in the rolling direction after stress relief annealing and a saturated magnetic flux density Bs of 0.85 or more and an core loss $W15/50_L$ of 2.0 W/kg or less, produced by the method of annealing the hot band at 800° C. to 1100° C. for 30 seconds or more to achieve a crystal grain size after final annealing of 50 μm or less, skin pass rolling the sheet by a reduction of 3% to 10%, then stress relief annealing it. Further, a cold rolling reduction of 60% to 75% is preferable.

6 Claims, No Drawings

NON-ORIENTED ELECTRICAL STEEL SHEET EXCELLENT IN MAGNETIC PROPERTIES IN ROLLING DIRECTION AND METHOD OF PRODUCTION OF SAME

BACKGROUND OF THE INVENTION

1. Field of the Invention

The present invention relates to non-oriented electrical steel sheet used as the material for an iron core of electrical equipment and its method of production. In particular, it relates to non-oriented electrical steel sheet superior in magnetic properties in the rolling direction after stress relief annealing.

2. Description of the Related Art

In recent years, due to the increasing global trend toward energy saving in electrical equipment, the non-oriented electrical steel sheets used as the materials for the iron cores of motors have been required to be further lowered in core loss and increased in magnetic flux density. In general, Si has been added to increase volume resistivity, the grain size of the product has been increased to reduce the core loss, and the hot band annealing and cold reduction have been optimized to increase the magnetic flux density.

On the other hand, as the method for producing small-sized motors, in recent years so-called segment type has been employed in increasing cases. In this method, steel sheet is punched and stacked in segment pieces, wire-wound, and joined to form an arc shaped stator core. The method has the advantages of improved yield of the steel sheet and improved winding packing rate. The method also has an advantage to enable an alignment of a specific direction of the steel sheet good in magnetic properties with for example the direction of teeth where the magnetic flux concentrate, by which an improvement in the motor efficiency can be expected.

As the steel sheet for such segment cores, use of grain-oriented electrical steel sheet with extremely good magnetic properties in the rolling direction may be considered, but the punchability of the sheet is poor and the cost ends up greatly increasing. So there have been almost no cases of its use in such motors but, like with conventional motors, non-oriented electrical steel sheet is being employed. That is, if it is possible to remarkably improve the magnetic properties in a specific direction in non-oriented electrical steel sheet, such sheet should be possible to be an optimal material for a segment type small-sized motor.

As a non-oriented electrical steel sheet for segment cores, for example, Japanese Unexamined Patent Publication No. 2004-332042 discloses a method wherein particularly controlling of a crystal grain size after hot band annealing and the reduction of cold rolling results in the development of a {100}<001> type texture after the final annealing and superior magnetic properties in the rolling direction and the direction vertical to the rolling direction of the surface.

However, in non-oriented electrical steel sheet up to now, the fact is that even in the rolling direction with good magnetic properties (hereinafter called the "L-direction"), the superiority of the magnetic properties over the other directions of the steel sheet is small. Furthermore, recently, there has been a growing need for thin and high Si content high grade sheets for the purpose of reducing a high frequency core loss and there has been the problem that the superiority of the L-direction magnetic properties becomes smaller in such steel sheets.

SUMMARY OF THE INVENTION

The present invention, in consideration of the above problems, provides a non-oriented electrical steel sheet extremely superior in L-direction magnetic properties at a low cost with larger crystal grain size and addition of large amounts of alloying elements.

The present invention was made to solve the above problems and has as its gist the following:

(1) Non-oriented electrical steel sheet excellent in magnetic properties in the rolling direction comprised of, by wt %, Si in an amount of 2.0% or less, Mn in 3.0% or less, Al in 1.0% to 3.0%, and the balance of Fe and unavoidable impurities and having a ratio of a magnetic flux density $B50_L$ in the rolling direction after stress relief annealing and a saturated magnetic flux density Bs ($B50_L$/Bs) of 0.85 or more.

(2) Non-oriented electrical steel sheet excellent in magnetic properties in the rolling direction as set forth in (1), wherein the steel sheet has an core loss $W15/50_L$ in the rolling direction after stress relief annealing of 2.0 W/kg or less.

(3) Non-oriented electrical steel sheet excellent in magnetic properties in the rolling direction as set forth in (1) or (2), wherein the steel sheet further contains, by wt %, Sn or Sb in an amount of 0.002% to 0.5%.

(4) Non-oriented electrical steel sheet excellent in magnetic properties in the rolling direction as set forth in (1) or (2), wherein the steel sheet further contains, by wt %, at least one of Cu, Ni, Cr, P, REM, Ca, and Mg in a total of 0.002% to 0.5%.

(5) A method of production of non-oriented electrical steel sheet excellent in magnetic properties in the rolling direction comprising producing steel sheet including, by wt %, Si in an amount of 2.0% or less, Mn in 3.0% or less, Al in 1.0% to 3.0%, and a balance of Fe and unavoidable impurities by hot rolling, hot band annealing, pickling, cold rolling, final annealing, and skin pass rolling during which skin pass rolling the final annealed steel sheet having a crystal grain size of 50 μm or less by a reduction of 3% to 10%.

(6) A method of production of non-oriented electrical steel sheet excellent in magnetic properties in the rolling direction comprising producing steel sheet including, by wt %, Si in an amount of 2.0% or less, Mn in 3.0% or less, Al in 1.0% to 3.0%, and a balance of Fe and unavoidable impurities by hot rolling, hot band annealing optionally, pickling, two or more cold rolling with intermediate annealing, final annealing, and skin pass rolling during which skin pass rolling the final annealed steel sheet having a crystal grain size of 50 μm or less by a reduction of 3% to 10%.

(7) A method of production of non-oriented electrical steel sheet excellent in magnetic properties in the rolling direction as set forth in (5) or (6), wherein said steel sheet further contains one or more of Sn, Sb, Cu, Ni, Cr, P, REM, Ca, and Mg in an amount of 0.002% to 0.5%.

(8) A method of production of non-oriented electrical steel sheet excellent in magnetic properties in the rolling direction as set forth in (5) or (6), wherein a final cold reduction in said cold rolling is 60% to 75%.

(9) A method of production of non-oriented electrical steel sheet excellent in magnetic properties in the rolling direction as set forth in (5) or (6), wherein at least the final annealing among the hot band annealing and intermediate annealing is performed at 800° C. to 1100° C. for 30 seconds or more.

According to the present invention, it is possible to provide, at a low cost, non-oriented electrical steel sheet extremely excellent in L-direction magnetic properties.

DESCRIPTION OF THE PREFERRED EMBODIMENTS

Below, the present invention will be explained in detail. The inventors have tried to further improve the magnetic properties in the L-direction, where the magnetic properties are most superior, in non-oriented electrical steel sheet. As a result, they have discovered and thereby completed the present invention that by adding 1.0% or more of Al to steel containing Si in an amount of 2.0% or less, final annealing, skin pass rolling at a reduction of 3 to 10% and stress relief annealing, the L-direction magnetic properties are extremely improved. Below, results of the experiments leading up to the present invention will be explained.

(Experiment 1)

Steel melts containing, by wt %, Si in an amount of 1.0%, Mn in an amount of 0.2%, and Al in an amount of 0.001 to 2.5% were prepared. Steel ingots of these were hot rolled to the sheet thicknesses of 2.7 mm, then the sheets were annealed at 1000° C. over 60 seconds and then cold rolled once to the sheet thicknesses of 0.37 mm. The cold rolled sheets were final annealed at 800° C. over 30 seconds, skin pass rolled by a reduction of 5%, then stress relief annealed at 780° C. for 1 hour and were then measured for the L-direction magnetic properties. As a result, as shown in Table 1, the inventors discovered that Samples 4 and 5 with amounts of Al of 1.0% or more exhibited low core loss and high magnetic flux density. The calculated values of the saturated magnetic flux density (Bs) are also shown. According to these, despite Samples 4 and 5 having low saturated magnetic flux densities, high magnetic flux densities were obtained. This is explained to be caused by the accumulation of easily magnetizable crystal orientations in the L-direction. Evaluating $B50_L$/Bs as a parameter indicating the degree of the accumulation, the inventors has discovered that the $B50_L$/Bs of the L-directions of Samples 4 and 5 reached 0.85 or more.

TABLE 1

| Sample | Si (%) | Al (%) | $W15/50_L$ (W/kg) | $B50_L$ (T) | Bs (T) | $B50_L$/Bs | Remarks |
|---|---|---|---|---|---|---|---|
| 1 | 1.1 | 0.001 | 2.6 | 1.71 | 2.11 | 0.81 | Comp. ex. |
| 2 | | 0.2 | 2.5 | 1.70 | 2.10 | 0.81 | Comp. ex. |
| 3 | | 0.4 | 2.2 | 1.69 | 2.09 | 0.81 | Comp. ex. |
| 4 | | 1.0 | 1.9 | 1.74 | 2.05 | 0.85 | Inv. ex. |
| 5 | | 2.5 | 1.8 | 1.73 | 1.96 | 0.88 | Inv. ex. |

(Experiment 2)

Next, to verify the effects of the amount of Si in the effects obtained in Experiment 1, the inventors produced a number of steels with different amounts of Si and Al and evaluated them under the same test conditions as Experiment 1. As a result, as shown in Table 2, if the amount of Si exceeds 2.0%, regardless of the amount of Al, no effect of improvement of the L-direction core loss or magnetic flux density can be obtained. On the other hand, the inventors discovered that Samples 3, 4, 7, 8, 11, and 12 with an amount of Si of 2.0% or less and having 1.0% or more of Al added were remarkably improved in core loss and magnetic flux density and exhibited high values of B50/Bs of 0.85 or more.

TABLE 2

| Sample | Si (%) | Al (%) | $W15/50_L$ (W/kg) | $B50_L$ (T) | $B50_L$/Bs | Remarks |
|---|---|---|---|---|---|---|
| 1 | 0.8 | 0.2 | 2.7 | 1.69 | 0.81 | Comp. ex. |
| 2 | | 0.5 | 2.3 | 1.70 | 0.83 | Comp. ex. |
| 3 | | 1.2 | 2.1 | 1.74 | 0.86 | Inv. ex. |
| 4 | | 2.5 | 2.0 | 1.74 | 0.90 | Inv. ex. |
| 5 | 1.5 | 0.2 | 2.4 | 1.67 | 0.80 | Comp. ex. |
| 6 | | 0.5 | 2.0 | 1.68 | 0.82 | Comp. ex. |
| 7 | | 1.2 | 1.8 | 1.72 | 0.85 | Inv. ex. |
| 8 | | 2.5 | 1.7 | 1.72 | 0.89 | Inv. ex. |
| 9 | 2.0 | 0.2 | 2.3 | 1.65 | 0.80 | Comp. ex. |
| 10 | | 0.5 | 2.1 | 1.65 | 0.81 | Comp. ex. |
| 11 | | 1.2 | 1.7 | 1.69 | 0.85 | Inv. ex. |
| 12 | | 2.5 | 1.6 | 1.70 | 0.89 | Inv. ex. |
| 13 | 2.5 | 0.2 | 2.3 | 1.67 | 0.82 | Comp. ex. |
| 14 | | 0.5 | 2.2 | 1.66 | 0.82 | Comp. ex. |
| 15 | | 1.2 | 2.2 | 1.63 | 0.82 | Comp. ex. |
| 16 | | 2.5 | 2.2 | 1.58 | 0.83 | Comp. ex. |

In this way, if the steel sheet containing Si limited to 2.0% or less and Al as high as 1.0% or more is final annealed, skin pass rolled and then stress relief annealed, the L-direction magnetic property is remarkably improved. The fact has been discovered for the first time by the present invention. As for the factor behind this effect, it is believed that by adding Al in an amount of 1.0% or more, at the time of final annealing, the Goss orientation ({110}<001>) and its nearby orientation slightly increase and this leads to preferential growth by stress relief annealing after skin pass rolling. Further, the reason why the effect is no longer exhibited when Si is over 2.0% is not certain, but it is believed that this results from Si having a greater action in hardening a material compared with Al.

Regarding the improvement of the magnetic properties by conventional skin pass rolling, for example, as seen in Japanese Unexamined Patent Publication No. 57-203718, the purpose is to promote the crystal grain growth after stress relief annealing so as to obtain a low core loss. This was solely applied to low grade steels with small Si contents. The reason is that high grade materials containing 2 to 3% or so of Si do not undergo transformation, so even without depending on skin pass rolling, the crystal grains can be increased in size and the core loss can be lowered by the simple means of raising the temperature of the final annealing.

The skin pass in the present invention is not simply a means for increasing the size of the crystal grains. But it is for controlling the crystal orientation so as to remarkably improve the L-direction magnetic properties. In particular, addition of 1.0% or more of Al to realize this has important significance. Al has a high effect, substantially equivalent to that of Si, of increasing the volume resistivity essential for reduction of the high frequency core loss. This enables replacement of part or all of the Si which is added in amounts of 2 to 3% or so in high grade materials with Al, and by applying the measures of the present invention it becomes possible to realize remarkable superiority of the magnetic properties in the L-direction, which had been particularly difficult in thin and high grade materials up to now.

As a prior art remarkably improving the L-direction magnetic properties, Japanese Unexamined Patent Publication No. 5-247537 discloses skin pass rolling in an angular direction within 45° of the longitudinal direction of the steel sheet, but skin pass rolling in an angular direction is industrially difficult.

Note that Japanese Unexamined Patent Publications Nos. 2002-146490 and 2005-240050 disclose high Al, skin pass rolled non-oriented electrical steel sheet similar to the present invention, but the methods of these publications cannot obtain non-oriented electrical steel sheet with a $B50_L/Bs \geqq 0.85$ like in the present invention. The reason is that since no hot band annealing is employed in the inventive examples of these publications, the Goss orientation ({110}<001>) and the orientation nearby are not sufficiently imparted.

Next, the reasons for limitation of the numerical values in the product of the present invention will be explained.

Si is an element effective for increasing the electrical resistance, but if added in an amount of over 2.0%, the effect of improvement of the magnetic properties in the L-direction is no longer sufficiently obtained, so 2.0% is the upper limit. The lower limit is, to increase the electrical resistance, preferably 0.4% or more, more preferably 0.5% or more, and further preferably 0.7% or more. In particular, in the case of high Al as in the present invention, since the $Al_2O_3$ scale after pickling increases if Si content is too small, an Si of over 1.0% is particularly preferable.

Mn is effective for the formation of sulfides and increasing the electrical resistance, so addition of 0.1% or more is preferable. The upper limit, considering the costs, is 3.0%.

Al is an essential element of the present invention. If Al is less than 1.0%, at the time of final annealing, the Goss orientation ({110}<001>) and the orientation nearby are not sufficiently developed and superior L-direction magnetic properties cannot be obtained after the stress relief annealing, so 1.0% or more is preferable. From the viewpoint of the $B50_L$/Bs, 1.5% or more, further 2.0% or more, is preferable. Further, since addition of Al gives a high volume resistivity substantially equal to Si, the amount of addition can be adjusted in accordance with the targeted core loss. In particular, to reduce the high frequency core loss increased addition of Al is preferable. However, considering the productivity of the casting etc., 3.0% is the upper limit. Considering the ease of operation, 2.7% or less, further 2.5% or less, is preferable.

Sn and Sb have the effect of increasing the Goss orientation at the time of final annealing. Further, since they have the effect of suppressing nitridation and oxidation at the time of annealing, their addition is preferable. Addition of 0.002% or more gives these effects. Since the effects become saturated if they are added over 0.5%, the upper limit is 0.5% or less.

Cu and Ni may be added since they have the effect of suppressing nitridation and oxidation at the time of annealing. In particular, addition with Sn is preferable. Addition of 0.002% or more gives these effects. Further, even if added in an amount of over 0.5%, Since the effects become saturated if they are added over the upper limit is 0.5% or less.

Cr has the effect of increasing the volume resistivity and improving the rust resistance. P has the effect of improving the crystal orientation and punchability. REM, Ca and Mg have the effect of improving the crystal grain growth at the time of hot band annealing, final annealing and stress relief annealing. In each case, the characteristics of the non-oriented electrical steel sheet are improved. The amount giving the effects is 0.002% or more. If they are added in an amount of over 0.5%, the effects become saturated.

Regarding the L-direction magnetic properties, from the results of experiments, the ratio of the magnetic flux density and saturated magnetic flux density ($B50_L$/Bs) is 0.85 or more and the commercial frequency core loss $W15/50_L$ is 2.0 W/kg or less. Here, the saturated magnetic flux density Bs is calculated by the formula, by wt %, of $2.1561-0.0413\times Si-0.0198\times Mn-0.0604\times Al$.

Next, the reasons for limitation of the production conditions in the present invention will be shown.

Regarding the hot band annealing and intermediate annealing, the temperature 800° C. or more is preferable for the need of sufficient crystal grain growth. However, since the surface properties is impaired when the crystal grains become too large, 1100° C. or less.

Regarding the cold rolling reduction, for the purpose of increasing the Goss orientation at the time of final annealing, 60% to 75% is preferable. If the reduction is not employed by the hot band annealing with a single cold rolling operation, after the hot rolled sheet annealing, intermediate cold rolling and intermediate annealing may be employed to achieve a reduction before final cold rolling of 60% to 75%. However, from the balance with the production costs, this range of cold reduction is not essential.

Since there is no grain growth in the stress relief annealing if the crystal grain size before the skin pass is too large, the upper limit of the grain size before skin pass is 50 μm. There is no lower limit so long as the recrystallization is completed.

The skin pass reduction is an important factor for causing priority growth in a specific orientation at the time of stress relief annealing. Since the stress imparted is not sufficient if the reduction is less than 3%, the lower limit is 3%. Since the stress is uniformly given and priority growth does not obtained if the reduction is over 10%, the upper limit of the reduction is 10%.

The stress relief annealing may be employed in the process of production of the non-oriented electrical steel sheet or may be employed by the customer after cores are punched. Further, it may be employed twice, that is, in the process of production of the steel sheet and after punching the cores. The annealing conditions are not limited so long as the conditions enable sufficient growth of the crystal grains and either box annealing or continuous annealing may be used. The sufficient growth of the crystal grains referred to here is the state where the average crystal grain size at a cross-section of the steel sheet is 60 μm or more. The annealing temperature is preferably 700 to 850° C. in the case of box annealing where generally the annealing time is as long as 10 minutes or more and is 850 to 1000° C. in the case of continuous annealing where the annealing time is as short as 10 to 60 seconds or so.

EXAMPLE 1

Steel melts containing, by wt %, Si in an amount of 1.0 to 3.0%, Mn in an amount of 0.5%, and Al in an amount of 0.3 to 2.4% were prepared. Steel ingots of these were hot rolled to a sheet thickness of 1.8 mm, the hot rolled sheets were annealed at 1050° C. over 60 seconds, then the sheets were cold rolled once to a sheet thicknesses of 0.37 mm. The cold rolled sheets were final annealed at 850° C. for 15 seconds to obtain a grain size of about 40 μm, then rolled by a skin pass of a reduction of 5% and stress relief annealed at 800° C. for 1 hour. Thus obtained samples were evaluated for magnetic properties in the L-direction. As a result, as shown in Table 3, Samples 3, 4, 7, and 8 with Si of 2.0% or less and Al of 1.0% or more were good in both core loss and magnetic flux density and had values of $W15/50_L$ of 2.0 W/kg or less and values of $B50_L$/Bs of 0.85 or more.

TABLE 3

| Sample | Si (%) | Al (%) | $W15/50_L$ (W/kg) | $B50_L$ (T) | $B50_L$/Bs | Remarks |
|---|---|---|---|---|---|---|
| 1 | 1.2 | 0.3 | 3.42 | 1.72 | 0.83 | Comp. ex. |
| 2 | | 0.6 | 3.05 | 1.71 | 0.83 | Comp. ex. |
| 3 | | 1.2 | 1.95 | 1.76 | 0.87 | Inv. ex. |
| 4 | | 2.4 | 1.77 | 1.74 | 0.89 | Inv. ex. |
| 5 | 1.8 | 0.3 | 3.11 | 1.68 | 0.82 | Comp. ex. |
| 6 | | 0.6 | 2.86 | 1.67 | 0.82 | Comp. ex. |

TABLE 3-continued

| Sample | Si (%) | Al (%) | $W15/50_L$ (W/kg) | $B50_L$ (T) | $B50_L/Bs$ | Remarks |
|---|---|---|---|---|---|---|
| 7 | | 1.2 | 1.88 | 1.73 | 0.87 | Inv. ex. |
| 8 | | 2.4 | 1.74 | 1.72 | 0.89 | Inv. ex. |
| 9 | 2.4 | 0.3 | 3.03 | 1.67 | 0.82 | Comp. ex. |
| 10 | | 0.6 | 2.33 | 1.65 | 0.82 | Comp. ex. |
| 11 | | 1.2 | 2.21 | 1.63 | 0.83 | Comp. ex. |
| 12 | | 2.4 | 2.16 | 1.58 | 0.83 | Comp. ex. |

EXAMPLE 2

Steel melts containing, by wt %, Si in an amount of 1.3, Mn in an amount of 1.0%, Al in an amount of 1.8%, and Sn in an amount of 0.003 to 0.2% were prepared. Steel ingots of these were hot rolled to a sheet thickness of 2.0 mm, the hot rolled sheets were annealed at 950° C. over 60 seconds, then the sheets were intermediate cold rolled to 0.65 to 2.0 mm (for 2.0 mm, no intermediate cold rolling), were intermediate annealed at 900° C. over 60 seconds (for 2.0 mm, no intermediate annealing), then final cold rolled to a sheet thicknesses of 0.26 mm. The cold rolled sheets were final annealed to a grain size of about 30 μm, then rolled by a skin pass of a reduction of 5% stress relief annealed at 750° C. for 2 hours. Thus obtained samples were evaluated for magnetic properties in the L-direction. As a result, as shown in Table 4, all the samples exhibited good magnetic properties such as $W15/50_L$ of 2.0 W/kg or less and values of $B50_L/Bs$ of 0.85 or more. In particular, Samples 5, 6, 9, and 10 with Sn added in an amount of 0.01% or more and with a final cold rolling reduction of 60 to 75% exhibited extremely good core loss and magnetic flux density.

TABLE 4

| Sample | Sn (%) | Intermediate cold rolling thickness (mm) | Final cold rolling reduction (%) | $W15/50_L$ (W/kg) | $B50_L$ (T) | $B50_L/Bs$ | Remarks |
|---|---|---|---|---|---|---|---|
| 1 | 0.003 | 0.7 | 62.9 | 1.79 | 1.73 | 0.88 | G |
| 2 | | 1.0 | 74.0 | 1.88 | 1.72 | 0.87 | G |
| 3 | | 1.5 | 82.7 | 1.91 | 1.70 | 0.86 | G |
| 4 | | 2.0 | 87.0 | 1.96 | 1.68 | 0.85 | G |
| 5 | 0.02 | 0.7 | 62.9 | 1.72 | 1.77 | 0.90 | VG |
| 6 | | 1.0 | 74.0 | 1.83 | 1.76 | 0.89 | VG |
| 7 | | 1.5 | 82.7 | 1.86 | 1.73 | 0.88 | G |
| 8 | | 2.0 | 87.0 | 1.91 | 1.71 | 0.87 | G |
| 9 | 0.12 | 0.7 | 62.9 | 1.68 | 1.78 | 0.90 | VG |
| 10 | | 1.0 | 74.0 | 1.71 | 1.77 | 0.90 | VG |
| 11 | | 1.5 | 82.7 | 1.76 | 1.74 | 0.88 | G |
| 12 | | 2.0 | 87.0 | 1.81 | 1.72 | 0.87 | G |

G: Good
VG: Very good

EXAMPLE 3

Steel melts containing, by wt %, Si in an amount of 1.5%, Mn in an amount of 1.5%, Al in an amount of 2.3%, Sn in an amount of 0.05%, Cu in an amount of 0.2%, and Ni in an amount of 0.3% were prepared. Steel ingots of these were hot rolled to a sheet thicknesses of 2.5 mm, the hot rolled sheets were annealed at 1000° C. over 60 seconds, then these were cold rolled to thicknesses of 0.30 to 0.35 mm. The cold rolled sheets were final annealed to a grain size of about 30 μm, then were skin pass rolled to a sheet thicknesses of 0.30 mm (for cold rolling thickness of 0.30 mm, no skin pass rolling), and were stress relief annealed at 750° C. for 2 hours. Thus obtained samples were estimated for magnetic properties in the L-direction. As a result, as shown in Table 5, Samples 4, 5, 7, 8, 10, and 11 with grain sizes after the final annealing of 50 μm or less and with skin pass reduction of 3 to 10% exhibited extremely good core loss and magnetic flux density.

TABLE 5

| Sample | Cold rolling thickness (mm) | Grain size after the final annealing (μm) | Skin pass reduction (%) | $W15/50_L$ (W/kg) | $B50_L$ (T) | $B50_L/Bs$ | Remarks |
|---|---|---|---|---|---|---|---|
| 1 | 0.30 | 25 | 0 | 2.87 | 1.61 | 0.84 | Comp. ex. |
| 2 | | 41 | 0 | 2.55 | 1.60 | 0.83 | Comp. ex. |
| 3 | | 65 | 0 | 2.34 | 1.60 | 0.83 | Comp. ex. |
| 4 | 0.31 | 26 | 3.2 | 1.81 | 1.72 | 0.89 | Inv. ex. |

TABLE 5-continued

| Sample | Cold rolling thickness (mm) | Grain size after the final annealing (μm) | Skin pass reduction (%) | $W15/50_L$ (W/kg) | $B50_L$ (T) | $B50_L/Bs$ | Remarks |
|---|---|---|---|---|---|---|---|
| 5 | | 42 | 3.2 | 1.94 | 1.70 | 0.88 | Inv. ex. |
| 6 | | 66 | 3.2 | 2.31 | 1.60 | 0.83 | Comp. ex. |
| 7 | 0.32 | 22 | 6.3 | 1.82 | 1.71 | 0.89 | Inv. ex. |
| 8 | | 43 | 6.3 | 1.73 | 1.73 | 0.90 | Inv. ex. |
| 9 | | 68 | 6.3 | 2.23 | 1.60 | 0.83 | Comp. ex. |
| 10 | 0.33 | 23 | 9.1 | 1.82 | 1.68 | 0.87 | Inv. ex. |
| 11 | | 44 | 9.1 | 1.79 | 1.70 | 0.88 | Inv. ex. |
| 12 | | 64 | 9.1 | 2.16 | 1.61 | 0.84 | Comp. ex. |
| 13 | 0.35 | 24 | 14.3 | 2.58 | 1.58 | 0.82 | Comp. ex. |
| 14 | | 45 | 14.3 | 2.51 | 1.59 | 0.83 | Comp. ex. |
| 15 | | 63 | 14.3 | 2.44 | 1.58 | 0.82 | Comp. ex. |

The invention claimed is:

1. A method of production of non-oriented electrical steel sheet excellent in magnetic properties in the rolling direction comprising producing steel sheet including, by wt %, Si in an amount of 2.0% or less, Mn in 3.0% or less, Al in 1.0% to 3.0%, and a balance of Fe and unavoidable impurities by hot rolling, hot band annealing, pickling, cold rolling, final annealing, and skin pass rolling the final annealed steel sheet having a crystal grain size of 50 μm or less by a reduction of 3% to 10%, and following said skin pass rolling, stress relief annealing.

2. A method of production of non-oriented electrical steel sheet excellent in magnetic properties in the rolling direction comprising producing steel sheet including, by wt%, Si in an amount of 2.0% or less, Mn in 3.0% or less, Al in 1.0% to 3.0%, and a balance of Fe and unavoidable impurities by hot rolling, hot band annealing optionally, pickling, two or more cold rolling with intermediate annealing, final annealing, and skin pass rolling the final annealed steel sheet having a crystal grain size of 50 μm or less by a reduction of 3% to 10%, and following said skin pass rolling, stress relief annealing.

3. A method of production of non-oriented electrical steel sheet excellent in magnetic properties in the rolling direction as set forth in claim 1 wherein said steel sheet further contains one or more of Sn, Sb, Cu, Ni, Cr, P, REM, Ca, and Mg in an amount of 0.002% to 0.5%.

4. A method of production of non-oriented electrical steel sheet excellent in magnetic properties in the rolling direction as set forth in claim 1 wherein a final cold reduction in said cold rolling is 60% to 75%.

5. A method of production of non-oriented electrical steel sheet excellent in magnetic properties in the rolling direction as set forth in claim 1, wherein the hot band annealing is performed at 800° C. to 1,100° C. for 30 seconds or more.

6. A method of production of non-oriented electrical steel sheet excellent in magnetic properties in the rolling direction as set forth in claim 2, wherein the intermediate annealing is performed at 800° C. to 1,100° C. for 30 seconds or more.

* * * * *